US006549187B1

(12) United States Patent
Matsubara et al.

(10) Patent No.: US 6,549,187 B1
(45) Date of Patent: Apr. 15, 2003

(54) LIQUID CRYSTAL DISPLAY

(75) Inventors: Ryouta Matsubara, Kumamoto (JP); Naoki Nakagawa, Kumamoto (JP); Satoshi Kohtaka, Kumamoto (JP)

(73) Assignee: Advanced Display Inc., Kikuchi-gun (JP)

( * ) Notice: Subject to any disclaimer, the term of this patent is extended or adjusted under 35 U.S.C. 154(b) by 298 days.

(21) Appl. No.: 09/594,023

(22) Filed: Jun. 15, 2000

(30) Foreign Application Priority Data

Jun. 25, 1999 (JP) ..... 11-180883

(51) Int. Cl.[7] ..... G09G 3/36; G09G 5/00

(52) U.S. Cl. ..... 345/96; 345/94; 345/95; 345/98; 345/100; 345/208; 345/209; 345/210

(58) Field of Search ..... 345/94, 95, 96, 345/98, 100, 208–210

(56) References Cited

U.S. PATENT DOCUMENTS 5,990,877 A * 11/1999 Yeo ..... 345/204
6,157,358 A * 12/2000 Nakajima et al. ..... 345/209
6,307,681 B1 * 10/2001 Aoki et al. ..... 340/14.1
6,310,596 B1 * 10/2001 Takasugi ..... 345/566
6,384,807 B1 * 5/2002 Furuhashi et al. ..... 345/87

FOREIGN PATENT DOCUMENTS

JP 11282008 A * 10/1999 ..... G02F/1/136

* cited by examiner

*Primary Examiner*—Bipin Shalwala
*Assistant Examiner*—Prabodh M. Dharia
(74) *Attorney, Agent, or Firm*—Oblon, Spivak, McClelland, Maier & Neustadt, P.C.

(57) ABSTRACT

An active matrix liquid crystal display of (2×1) dot inversion driving system, wherein in a case where the active matrix display is driven, voltage is applied to the pixels in such a manner that polarity is changed every source line in the horizontal direction and every two gate lines in the vertical direction. Further, a plurality of pixels is provided with a switching element, and charging characteristics of the pixels are made uniform both at the time of selecting the n-th line gate wire 1 at which the polarity of the source potential is inverted and at the time of selecting the (n+1)th line gate wire 2 at which no inversion is made in the source potential, whereby unevenness in luminance occurring in each line in raster display can be reduced.

14 Claims, 15 Drawing Sheets

83
81
n-th LINE 84
82
(n+1)th LINE 83
81
(n+2)th LINE 84
82
(n+3)th LINE
TIME 2H
1H
103
101 n-th LINE
104
102

(n+1)th LINE
103
101

(n+2)th LINE
104
102

(n+3)th LINE
TIME

LIQUID CRYSTAL DISPLAY

BACKGROUND OF THE INVENTION

The present invention relates to an active matrix liquid crystal display, and more particularly concerns a liquid crystal display which can eliminate uneven luminance occurring every other line in a (2×1) dot-inversion driving system.

Liquid crystal displays, which carry out a display process by controlling a voltage to be applied to a liquid crystal while combining photoelectric characteristics of the liquid crystal and deflection plates, are lighter as compared with CRTs and superior in portability, and have been widely used in recent years as display devices for mobile computers, etc. Among these, active matrix liquid crystal displays, which have a switching element such as a TFT for each of the pixels so as to control a voltage to be applied to the liquid crystal, are superior in display quality as compared with simple-matrix type liquid crystal displays, and have been intensively developed and come to be widely used.

FIGS. 12(*a*) and 12(*b*) show an equivalent circuit of a base active matrix liquid crystal display, and an explanation will be given of the operation thereof. A switching element 123 such as a TFT, a liquid crystal capacitance 128 and an auxiliary capacitance 129 are formed at an intersection between a gate line 121 and a source line 122; thus, a pixel is formed. These pixels are arranged in a matrix format so as to form a pixel array. When a selection pulse is applied to one of the gate lines, all the switching elements connected to the gate line are turned on, with the result that signals applied to the source lines connected to the switching elements are written in the liquid crystal capacitance and the auxiliary capacitance. On the other hand, when the gate line comes to a non-selected state, the switching elements are turned off, with the result that charges stored in the liquid crystal capacitance and the auxiliary capacitance are held until a selection pulse is inputted to the gate line after a lapse of one vertical scanning period.

FIG. 13 shows gate electrical potential Vg, a source electrical potential Vs, and a pixel electrical potential Vd in raster display of (2×1) dot inversion driving system. FIG. 13 shows a case in which, when n-th scanning line is selected, the polarity of a source signal is inverted to (131).

In the (2×1) dot inversion driving system in which the polarity of the pixel potential is allowed to change for every two lines of adjacent pixels in the vertical direction and for every one row thereof in the horizontal direction, source potentials having different polarities are inverted for every two horizontal scanning periods for every adjacent source wires. In the case when raster (the same color on the entire screen) display is made in the above-mentioned driving system, at the time of selecting n-th gate at which the polarity of the source signal is inverted, a delay for approximately several microseconds occurs until the source potential has reached a predetermined potential. This is mainly because, since the output resistivity of the source IC is several kilo-ohms and the wiring resistivity of the source potential is approximately several K to several tens kΩ, the above-mentioned time is required for charging the source wiring and pixel electrode. In contrast, at the time of selecting (n+1)th gate (132) at which no inversion is made in the source potential, the source potential has reached a predetermined potential at the time when the gate wiring is selected. Consequently, in the conventional technique as shown in FIG. 13, since the effective writing time to the pixel electrode is shorter at the time of selection of the n-th gate than that at the time of selection of the (n+1)th gate, unevenness in luminance occur for each line in the raster display.

There are various driving systems for the active matrix liquid crystal display, and in order to prevent flickers on the screen at the time of shut-out of windows, the (2×1) dot inversion driving system in which the polarities of adjacent pixels are inverted for every two lines in the vertical direction and for every one row thereof in the horizontal direction have come to be widely used in recent years.

In the conventional (2×1) dot inversion driving system, since the gate wires are selected for each line as illustrated in FIG. 14, a selection pulse is inputted to the gate wire only once during on horizontal scanning period. Therefore, in the above-mentioned driving system, a charging process to the pixel has to be finished during one horizontal scanning period when the gate wire is selected by the selection pulse only once.

In general, in the (2×1) dot inversion driving process is used in order to prevent flickers occurring on the screen at the time of shut-out of windows. These flickers become conspicuous as the high-precision and large size of the active matrix liquid crystal displays are achieved; therefore, the (2×1) dot inversion driving system has come to be adopted to high-precision or large size active matrix liquid crystal displays. However, as the high-precision and large size of the active matrix liquid crystal displays are achieved, it becomes more difficult to finish the charging process to the pixel during one horizontal scanning period, and the above-mentioned unevenness in luminance for each line tends to become more conspicuous.

Since one horizontal scanning period is shortened following the recent developments of high-precision or large size active matrix liquid crystal displays, the conventional technique has come to fail to charge the pixel during one horizontal scanning period. FIG. 15 shows waveforms of a certain pixel gate potential 151, source potential 152 and pixel potential 153 in the conventional driving system. When a selection pulse is inputted to the gate wire, a certain positively polarized source potential V3 is written in the pixel potential in which a certain negatively polarized source potential V1 has been written (variations in the pixel potential due to a parasitic capacitance are not shown in the waveforms in the Figure). Normally, the polarity of a voltage to be applied to a liquid crystal is inverted for each vertical scanning period in order to prevent degradation in the liquid crystal; therefore, in the case when a liquid crystal of 5V system is used, the difference between V1 and V3 is approximately 8V at maximum, and in the case of an auxiliary capacitance of 0.2 (pF) and a liquid crystal capacitance of 0.3 (pF), the system has to be designed so as to charge a voltage of approximately 8V to a capacitance of 0.5 (pF) within one horizontal scanning period. However, in recent developments of high-precision or large size active matrix liquid crystal displays, the one horizontal scanning period is further shortened, and it becomes more difficult to charge the pixel within one horizontal scanning period.

SUMMARY OF THE INVENTION

In the liquid crystal display of the present invention which is n active matrix liquid crystal device of the (2×1) dot inversion driving system, charging characteristics of the pixel are made uniform both at the time of selecting the n-th line gate wire 1 at which the polarity of the source potential is inverted and at the time of selecting the (n+1)th line gate wire 2 at which no inversion is made in the source potential.

Moreover, as compared with a first selection pulse at the time of selecting the n-th line gate wire 1, a second selection pulse at the time of selecting the (n+1)th line gate wire 2 is set to have a shorter width.

Moreover, the first selection pulse is delayed and both of the widths of the first selection pulse and the second selection pulse are made smaller.

Furthermore, a control pulse for desirably setting the time and width of the first selection pulse and the second selection pulse is provided.

Here, the driving capability of the switching element placed in the pixel on n-th line gate wire 1 is made greater than the driving capability of the switching element placed in the pixel on (n+1)th line gate wire 2.

Moreover, the driving capability of the switching element placed in the pixel on the (n+1)th line gate wire 2 is controlled for a predetermined time after having reached the ON state.

Furthermore, a third or fourth selection pulse is inputted prior to the first and second selection pulses in such a time zone as to allow the source potential to have the same polarity as the selected time; thus, the pixel potential is preliminarily charged.

(1) In the (2×1) dot inversion driving system, the driving system is devised so as to prevent unevenness in luminance for each line.

(2) In the (2×1) dot inversion driving system, as shown in FIG. 1, before a first selection pulse Vg 11 is inputted to a gate wire that is scanned for each line charging characteristics of the pixel, a third selection pulse 13 is inputted to the gate wire; this driving system makes it possible to improve the pixel charging characteristics.

FIG. 2 shows waveforms of a gate potential, source potential and pixel potential of a certain pixel in the present invention. In the conventional technique, the writing process V1 to V3 has to be finished within a selection period by the first selection pulse 11; in contrast, in the present invention, to the pixel potential which has held V1, a predetermined positively polarized source potential V2 is charged by the third selection pulse 13, and in the charging process by the first selection pulse 11, the voltage width in charging is made smaller as indicated by V2 to V3 as compared with the conventional technique; consequently, the charging characteristics can be improved. However, when the polarity of the source potential is different depending on the cases when the third selection pulse 13 is inputted to the gate wire and when the first selection pulse 11 is inputted thereto, the charging characteristics deteriorate; therefore, the polarity of the source potential has to be maintained the same at the time when the third selection pulse 13 and the first selection pulse 11 are respectively inputted to the gate wire. Here, in the FIG., 2H represents two horizontal scanning periods.

DETAILED DESCRIPTION

Embodiment 1

Figure 3:
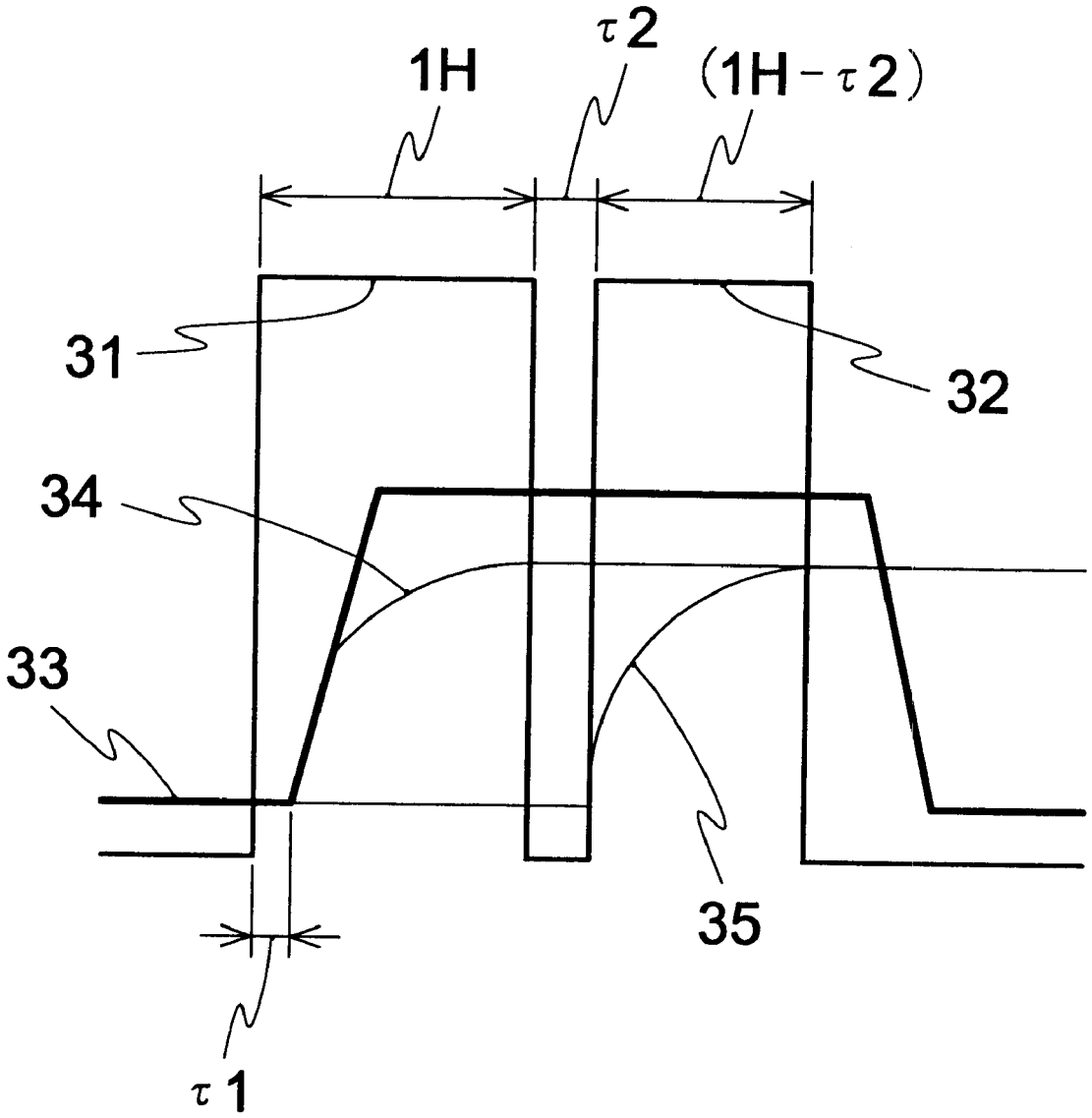
FIG. 3 is a graph of operating wave form for showing a function of EMBODIMENT 1 of the present invention.

Referring to FIG. 3, an explanation will be given of one embodiment in which, in order to reduce unevenness in luminance occurring in each line in raster display in the (2×1) dot inversion driving system, charging characteristics of the pixel are made uniform both at the time of selecting the n-th line gate wire 1 at which the polarity of the source potential is inverted and at the time of selecting the (n+1)th line gate wire 2 at which no inversion is made in the source potential.

In the (2×1) dot inversion driving system, the pulse width of a second selection pulse 32 to be inputted to a gate wire 2 is made smaller than a first selection pulse 31 to be inputted to a gate wire 1.

As illustrated in FIG. 3, the following arrangement is made: time τ1 micro-second (μsec) before the polarity inversion of the source potential, the selection pulse 31 is inputted to the gate wire 1 while τ1 is set to the same level as the delay time of the selection pulse 31; the pulse width of the selection pulse 1 is set to the one horizontal scanning period; the timing of the rise of the selection pulse 32 is set to time τ2 after the rise of the selection pulse 31; and the pulse width of the selection pulse 32 is set to be smaller than one horizontal scanning period by τ2.

In the conventional technique, when raster display is carried out in the (2×1) dot inversion driving system, a delay occurs from the inversion of the source potential until it has reached a predetermined potential, at the time of selecting the gate wire 1, while the source potential is maintained the same as that at the time of selecting the gate wire 1, at the time of selecting the gate wire 2. Therefore, as compared with the pixel charging characteristics at the time of selecting the gate wire 2, the pixel charging characteristics deteriorate at the time of selecting the gate wire 1.

For this reason, in the present invention, the pulse width of the second selection pulse is made smaller than that of the first selection pulse 1 by τ2 so that the pixel charging characteristic at the time of lo selecting the gate wire 2 is suppressed as compared with the conventional system; thus, charging characteristics of the pixel are made uniform both at the time of selecting the gate wire 1 and at the time of selecting the gate wire 2 so that it is possible to reduce unevenness in luminance occurring in each line of gate wires in raster display.

Embodiment 2

An explanation will be given of another embodiment in which, in order to reduce unevenness in luminance occurring in each line in raster display in the (2×1) dot inversion driving system, charging characteristics of the pixel are made uniform both at the time of selecting the n-th line gate wire 1 at which the polarity of the source potential is inverted and at the time of selecting the (n+1)th line gate wire 2 at which no inversion is made in the source potential.

Figure 4:
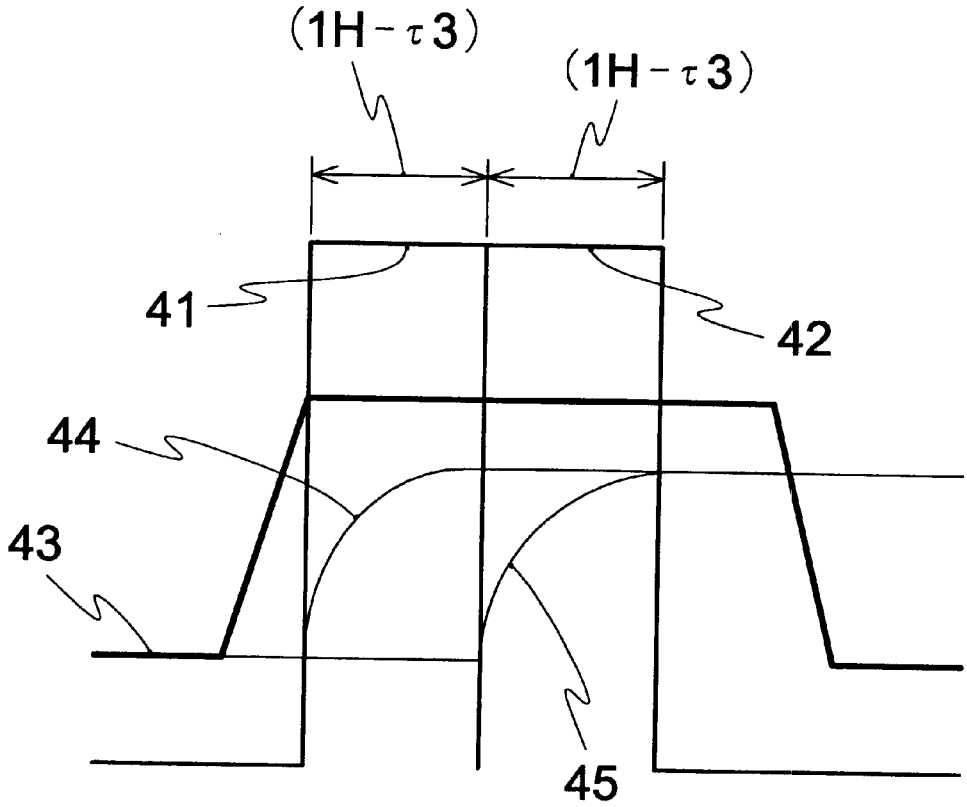
FIG. 4 is a graph of operating wave form for showing a function of EMBODIMENT 2 of the present invention.

As illustrated in FIG. 4, after the source potential whose polarity can be inverted has reached a predetermined potential, the selection pulse 41 is inputted to the gate wire 1; the pulse width of the first selection pulse 41 is set to a pulse width obtained by subtracting time τ3 from the horizontal scanning period; τ3 is set to a value greater than an addition of the delay time of the selection pulse 41 and the delay time of the source potential; the second selection pulse 42 is inputted to the gate wire 2 at the time when the first selection pulse 41 falls; and the pulse widths of the first selection pulse 41 and the second selection pulse 42 are set to be the same.

In the conventional technique, when raster display is carried out in the (2×1) dot inversion driving system, a delay occurs from the inversion of the source potential until it has reached a predetermined potential, at the time of selecting the gate wire 1, while the source potential is maintained the same as that at the time of selecting the gate wire 1, at the time of selecting the gate wire 2. Therefore, as compared with the pixel charging characteristics at the time of selecting the gate wire 2, the pixel charging characteristics deteriorate at the time of selecting the gate wire 1.

For this reason, in the present invention, after the source potential has reached a predetermined potential, the first selection pulse 41 and the second selection pulse 42 are respectively inputted to the gate wire 1 and the gate wire 2 so that pixel charging characteristics are set to be the same at the time of selecting the gate wire 1 and at the time of selecting the gate wire 2; thus, it is possible to reduce unevenness in luminance occurring in each line of gate wires in raster display.

Embodiment 3

In the present embodiment, an explanation will be given of the setting method of the time and pulse width of the selection pulse in the above-mentioned embodiment.

Figure 5:
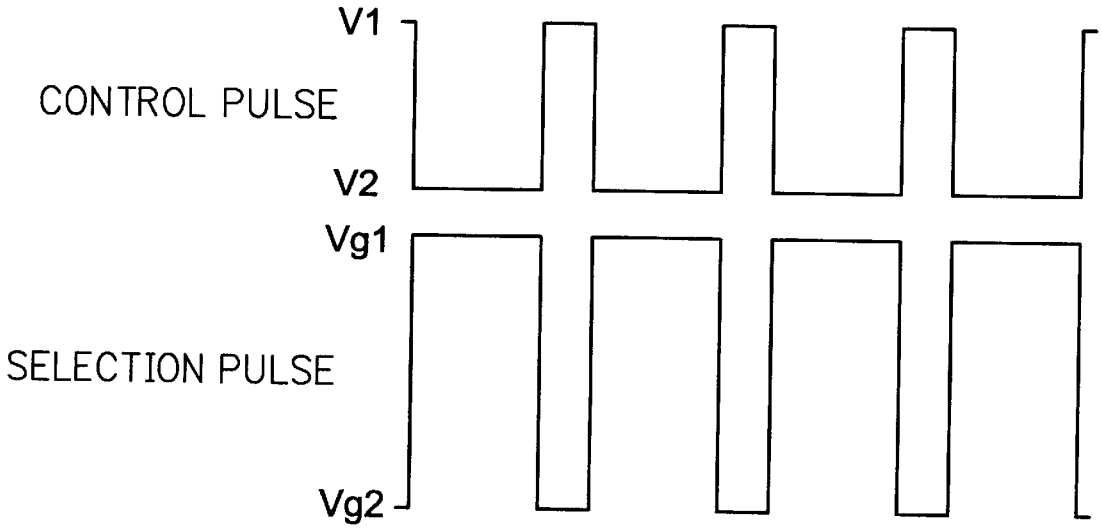
FIG. 5 is a graph of operating wave form for showing a function of EMBODIMENT 3 of the present invention.

In the (2×1) dot inversion driving system, when the selection pulse is formed by Vg1 and Vg2 as illustrated in FIG. 5, control pulses having 0 and Vcc are formed on the circuit substrate of the active matrix liquid crystal display, and when the control pulse potential is Vcc, the selection pulse Vg2 is inputted to the gate wire, and when the control pulse potential is 0, the selection pulse Vg1 is inputted thereto; thus, setting is made. This arrangement makes it possible to set the width and time of the selection pulse desirably in the (2×1) dot inversion driving system.

Embodiment 4

Referring to FIG. 3, an explanation will be given of one embodiment in which, in order to reduce unevenness in luminance occurring in each line in raster display in the (2×1) dot inversion driving system, charging characteristics of the pixel are made uniform both at the time of selecting the n-th line gate wire at which the polarity of the source potential is inverted and at the time of selecting the (n+1)th line gate wire 2 at which no inversion is made in the source potential.

Figure 6:
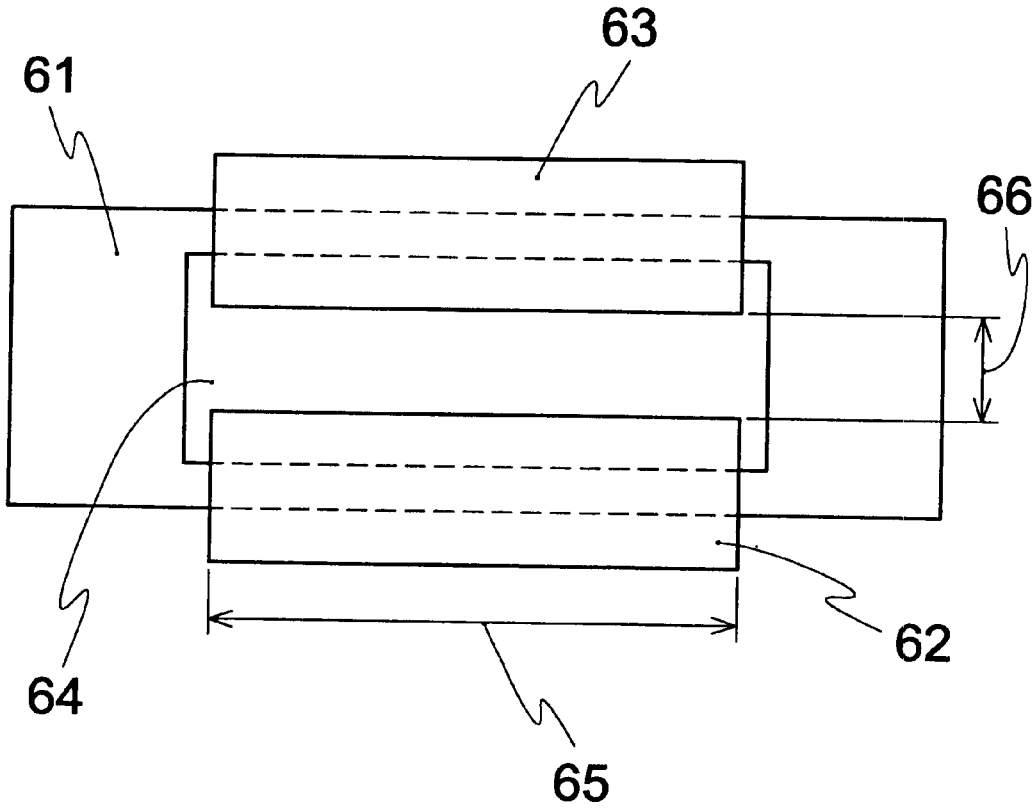
FIG. 6 is a plan view illustrating a construction of TFT of the liquid crystal display of EMBODIMENT 4 of the present invention.

In the (2×1) dot inversion driving system, with respect to W/L which is a ratio of the channel width and channel length of the a-Si TFT element that is placed on a pixel on a gate wire, the W/L of the element placed on the pixel on the gate wire 1 is set greater than the W/L of that placed on the pixel on the gate wire 2. FIG. 6 shows portions of the channel width and channel length in a TFT element. In the conventional technique, when raster display is carried out in the (2×1) dot inversion driving system, a delay occurs from the inversion of the source potential until it has reached a predetermined potential, at the time of selecting the gate wire 1, while the source potential is maintained the same as that at the time of selecting the gate wire 1, at the time of selecting the gate wire 2. Therefore, as compared with the pixel charging characteristics at the time of selecting the gate wire 2, the pixel charging characteristics deteriorate at the time of selecting the gate wire 1.

Therefore, in the present invention, the TFT characteristic of the pixel on the gate wire 2 is set to have a smaller charging capability as compared with the TFT on the gate wire 1; thus, pixel charging characteristics are set to be the same at the time of selecting the gate wire 1 and at the time of selecting the gate wire 2. Consequently, it becomes possible to reduce unevenness in luminance occurring in each line of gate wires in raster display.

Embodiment 5

An explanation will be given of another embodiment in which, in order to reduce unevenness in luminance occurring in each line in raster display in the (2×1) dot inversion driving system, charging characteristics of the pixel are made uniform both at the time of selecting the n-th line gate wire 1 at which the polarity of the source potential is inverted and at the time of selecting the (n+1)th line gate wire 2 at which no inversion is made in the source potential.

Figure 7:
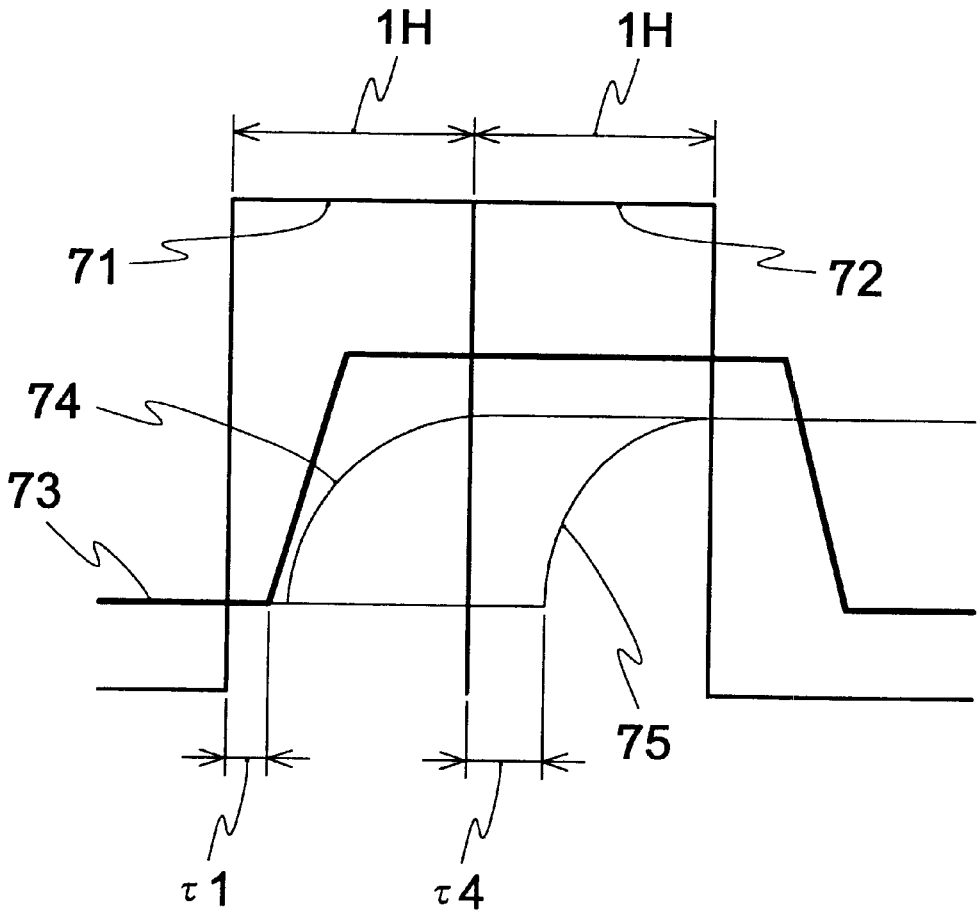
FIG. 7 is a graph of operating wave form for showing a function of EMBODIMENT 5 of the present invention.

In the (2×1) dot inversion driving system, as illustrated in FIG. 7, in the case when the second selection pulse 72 is inputted to the gate wire 2, the source IC is maintained in a non-output state for a predetermined period after the input of the second selection pulse 72.

In the conventional technique, when raster display is carried out in the (2×1) dot inversion driving system, a delay occurs from the inversion of the source potential until it has reached a predetermined potential, at the time of selecting the gate wire 1, while the source potential is maintained the same as that at the time of selecting the gate wire 1, at the time of selecting the gate wire 2. Therefore, as compared with the pixel charging characteristics at the time of selecting the gate wire 2, the pixel charging characteristics deteriorate at the time of selecting the gate wire 1.

In the present invention, the source IC is set in a non-output state for a predetermined time τ4 at the time of selecting the gate wire 2 so that the charging time at the time of selecting the gate wire 2 is shortened; thus, thus, pixel charging characteristics are set to be the same at the time of selecting the gate wire 1 and at the time of selecting the gate wire 2. Consequently, it becomes possible to reduce unevenness in luminance occurring in each line of gate wires in raster display.

Embodiment 6

The following description will discuss another embodiment in which, in order to improve pixel charging characteristics in the (2×1) dot inversion driving system, prior to inputting a selection pulse to a gate wire, a selection pulse is inputted to the gate wire.

Figure 1:
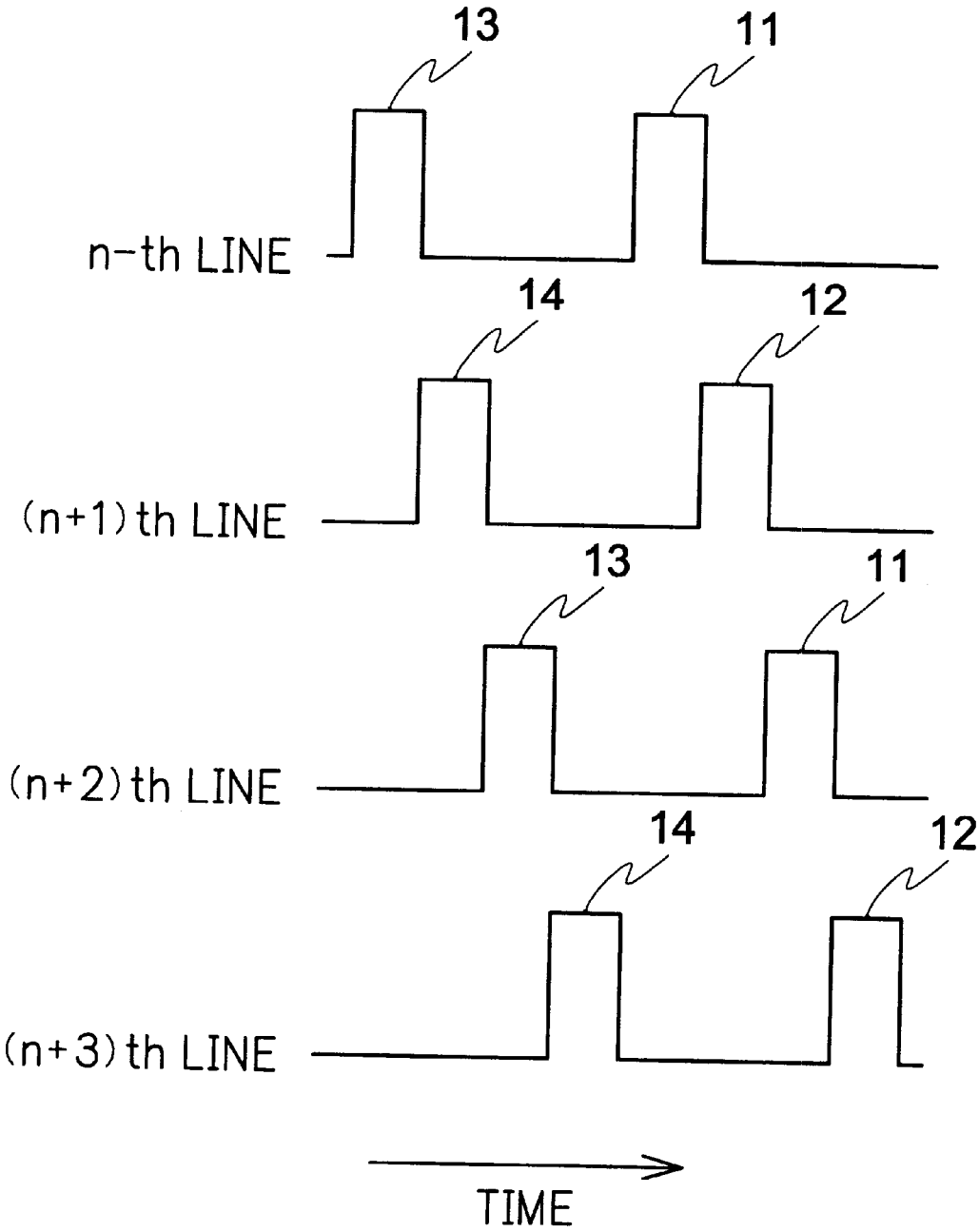
FIG. 1 is a graph of operating wave form for showing a function of the embodiment of the present invention.
Figure 2:
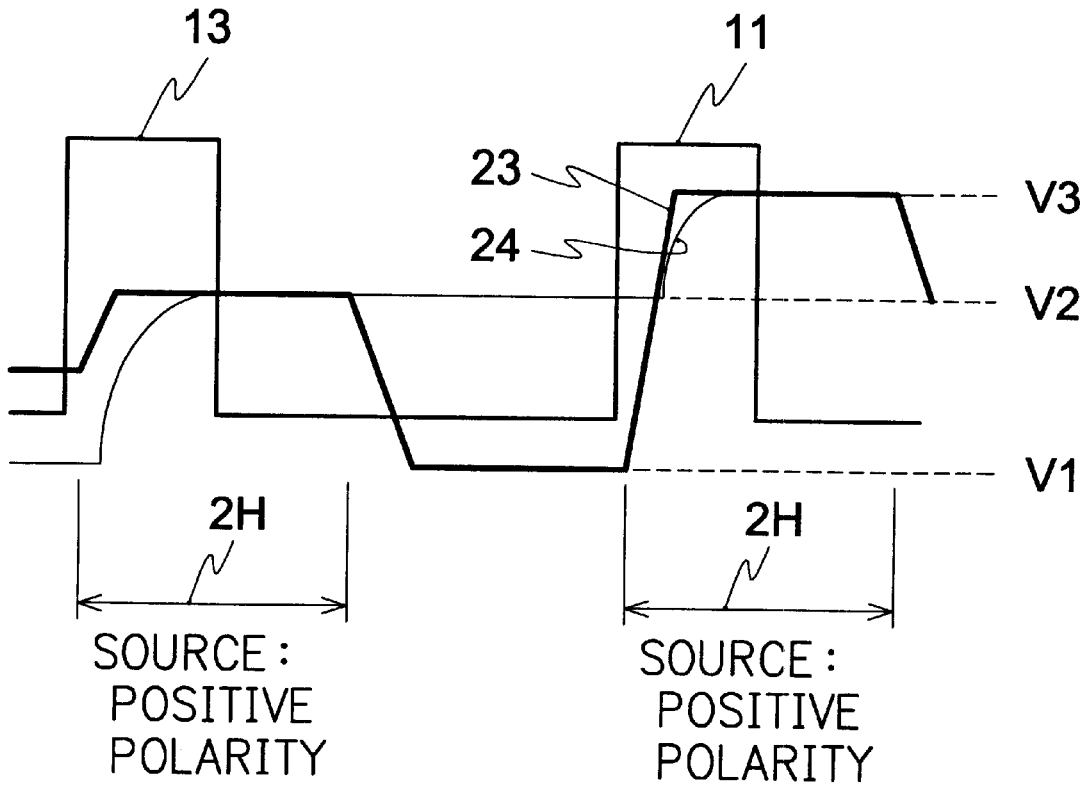
FIG. 2 is a graph of operating wave form for showing a function of the embodiment of the present invention.
Figures 8A, 8B, 8C, 8D:
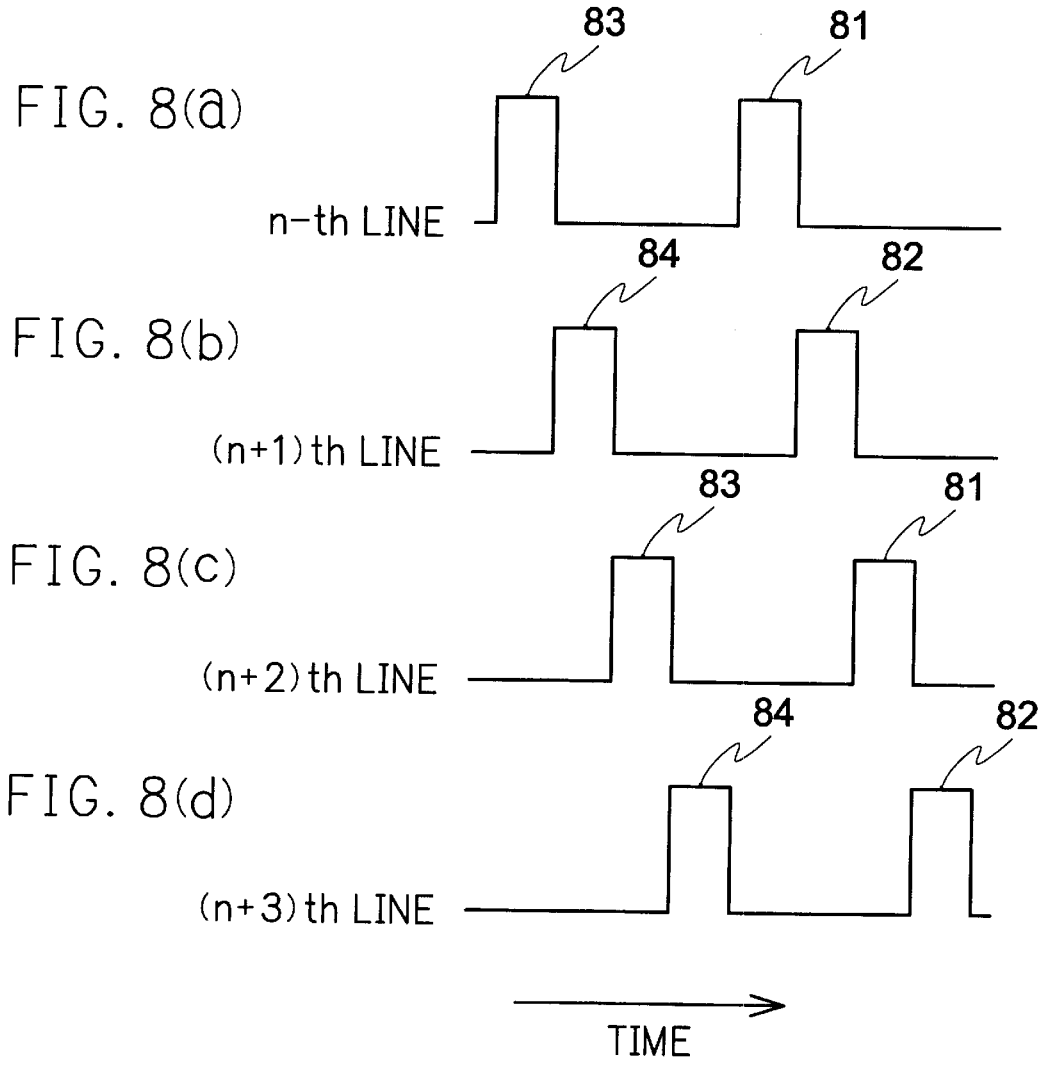
FIGS. 8(*a*)–8(*b*) are graphs of operating wave forms for showing a function of EMBODIMENT 6 of the present invention.
Figure 9A:
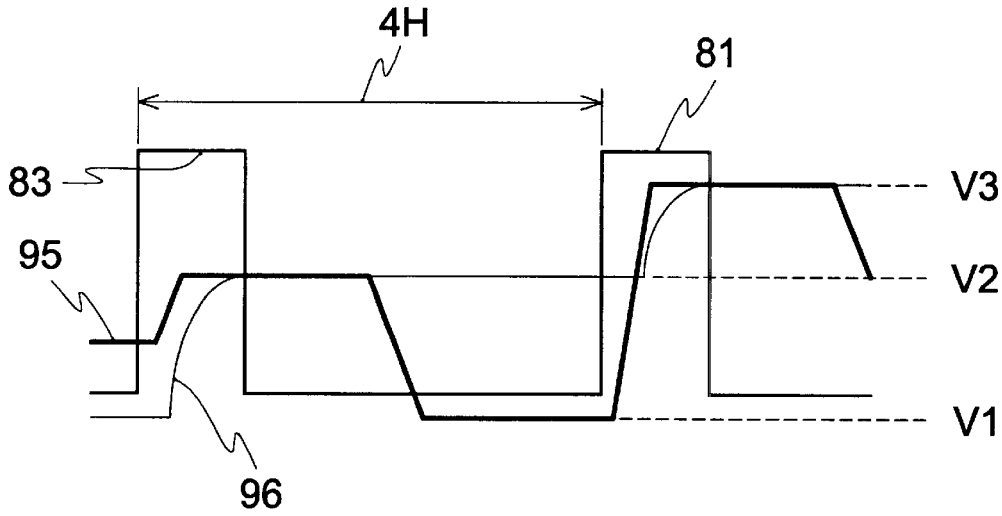
FIGS. 9(*a*)–9(*b*) are graphs of operating wave forms for showing a function of EMBODIMENT 6 of the present invention.
Figure 9B:
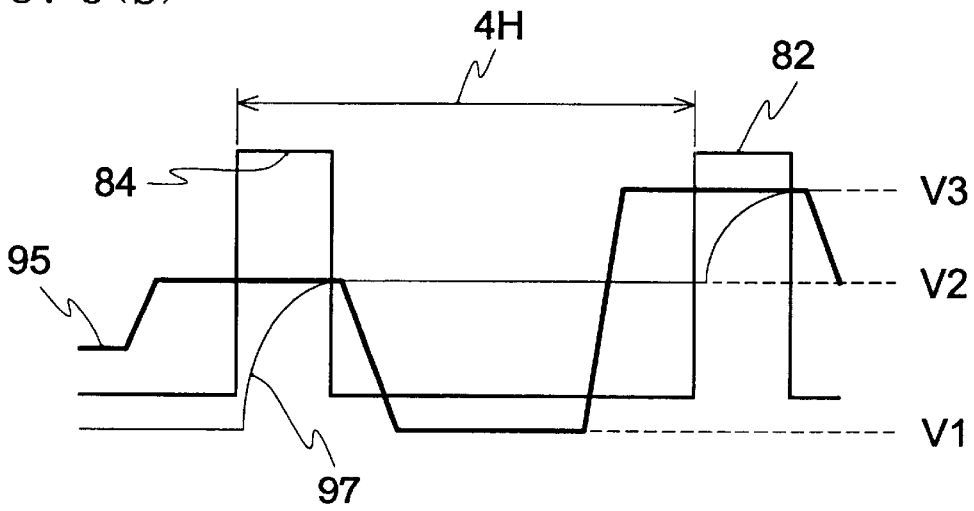

In the (2×1) dot inversion driving system, FIGS. 8(*a*)–8(*d*) show gate waveforms 81, 82, 83 and 84 in the same manner as FIG. 1; and FIGS. 9(*a*)–9(*b*) show waveforms of gate potentials 81, 82, 83 and 84, a source potential 95, pixel potentials 96 and 97 of arbitrary pixels on n-th line and (n+1)th line. FIG. 8(*a*) corresponds to FIG. 9(*a*) and FIG. 8(*b*) corresponds to FIG. 9(*b*), respectively. Prior to inputting a first selection pulse 81, having (4×m) horizontal scanning period (m=1, 2, 3, . . . ), in the gate wire 1, a third selection pulse 83 having the same pulse width as the selection pulse 81 is inputted to the gate wire 1 (FIG. 9(*a*).

Prior to the second pulse 82, a fourth selection pulse 84 is inputted in the same manner (FIG. 9(*b*)). FIGS. 8(*a*)–8(*b*) and 9(*a*)–9(*b*) show cases in which m=1.

The reason that the selection pulses 83 and 84 are inputted to the gate wire 1 prior to (4×m) horizontal scanning period (m=1, 2, 3, . . . ) is because in the (2×1) dot inversion driving system, the period in which the polarity of the source potential is inverted is set to 4 horizontal scanning periods. In the conventional technique, the writing process V1 to V3 has to be finished within a selection period by the selection pulse 81; in contrast, in the present invention, to the pixel potential which has held V1, a predetermined positively polarized source potential V2 is charged by the selection pulse 83, and in the charging process by the selection pulse 81, the voltage width in charging is made smaller as indicated by V2 to V3 as compared with the conventional technique; consequently, the charging characteristics can be improved.

Embodiment 7

The following description will discuss another embodiment in which, in order to improve pixel charging characteristics in the (2×1) dot inversion driving system, prior to inputting a selection pulse to a gate wire, a selection pulse is inputted to the gate wire.

Figures 10A, 10B, 10C, 10D:
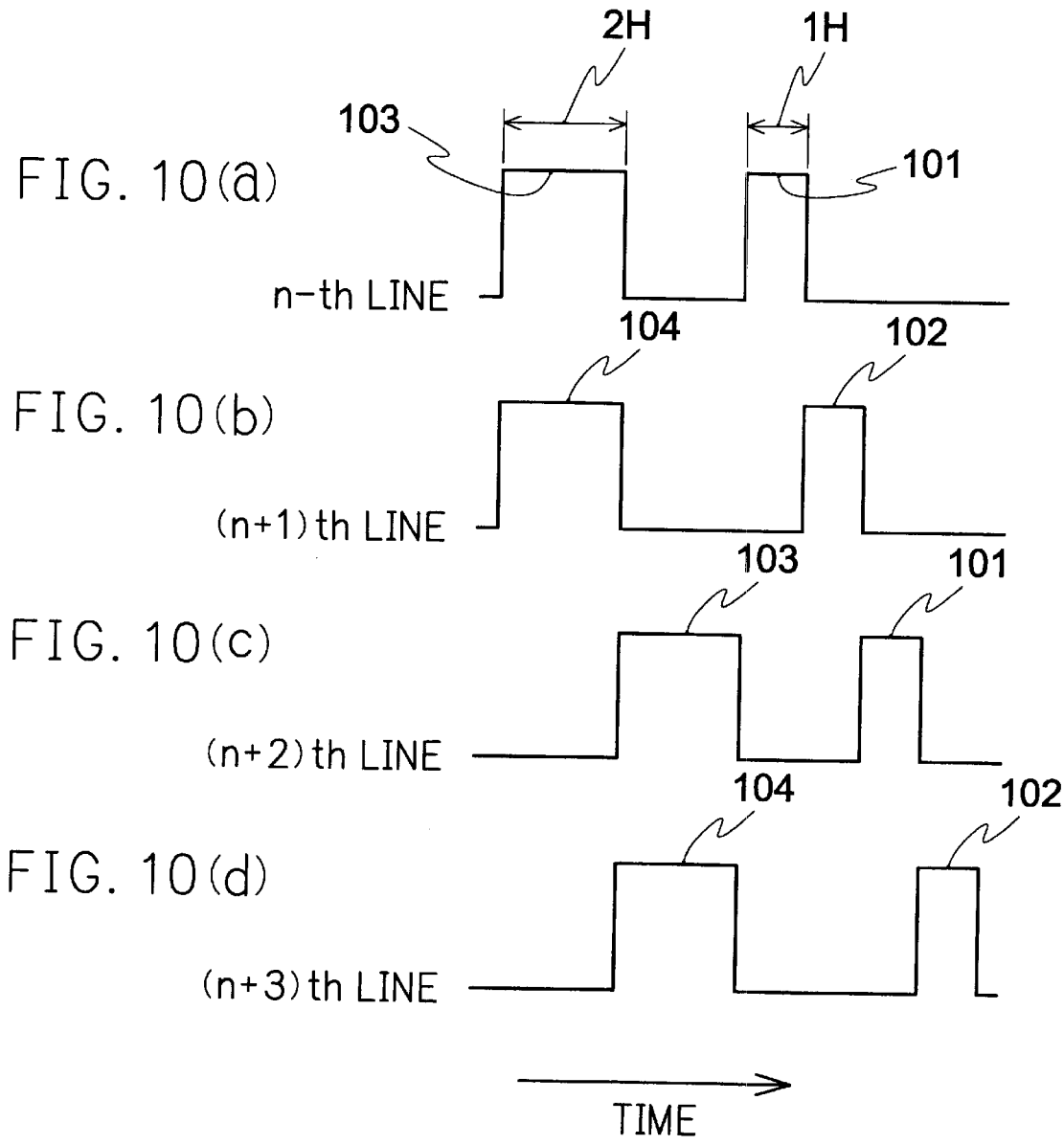
FIGS. 10(*a*)–10(*d*) are graphs of operating wave forms for showing a function of EMBODIMENT 7 of the present invention.
Figure 11A:
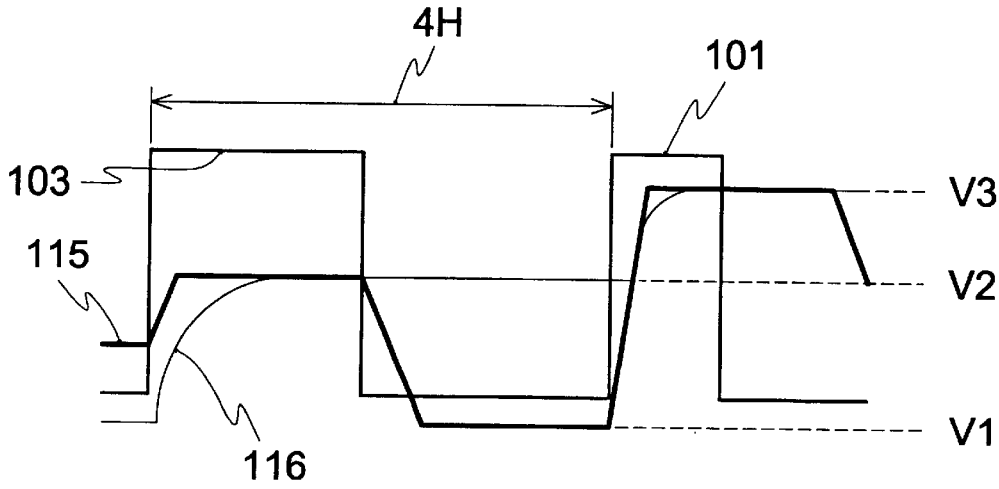
FIGS. 11(*a*)–11(*b*) are graphs of operating wave forms for showing a function of EMBODIMENT 7 of the present invention.
Figure 11B:
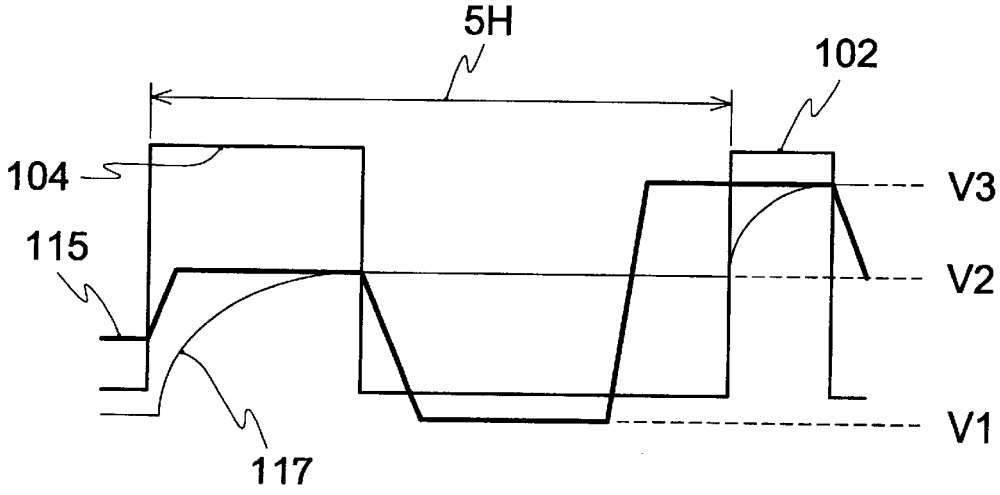
Figure 12A:
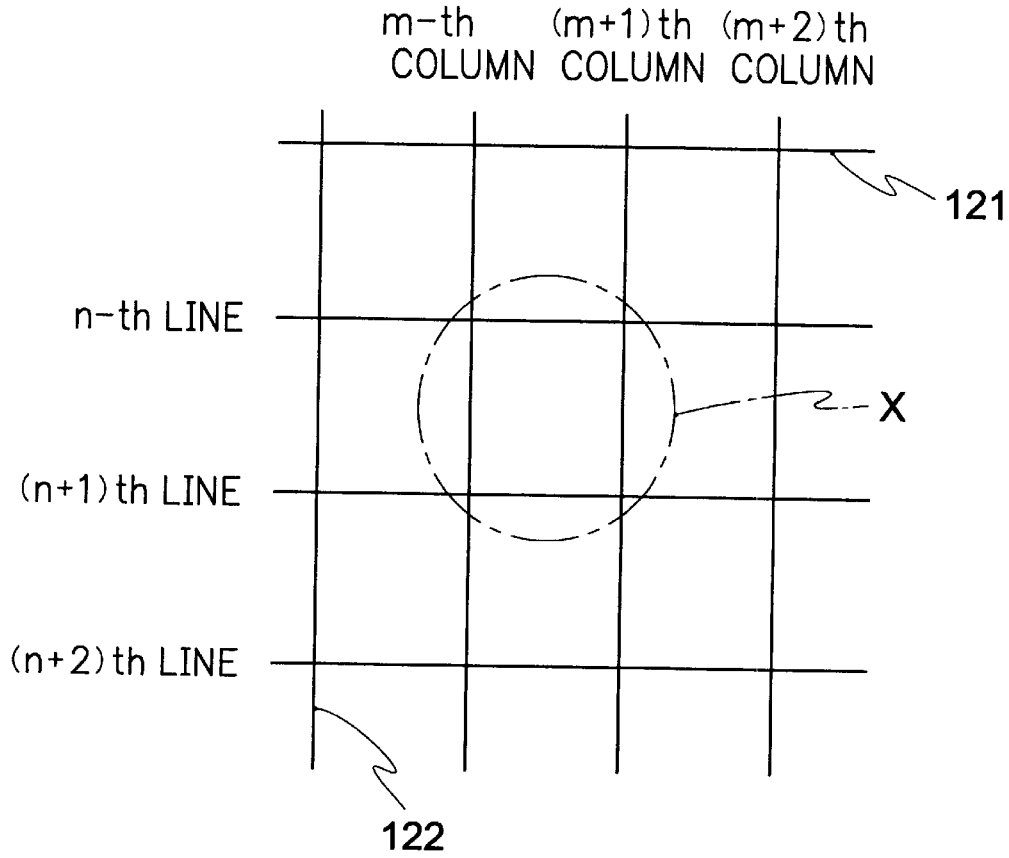
FIGS. 12(*a*)–12(*b*) are equivalent circuit diagrams showing a construction of the active matrix liquid crystal display.
Figure 12B:
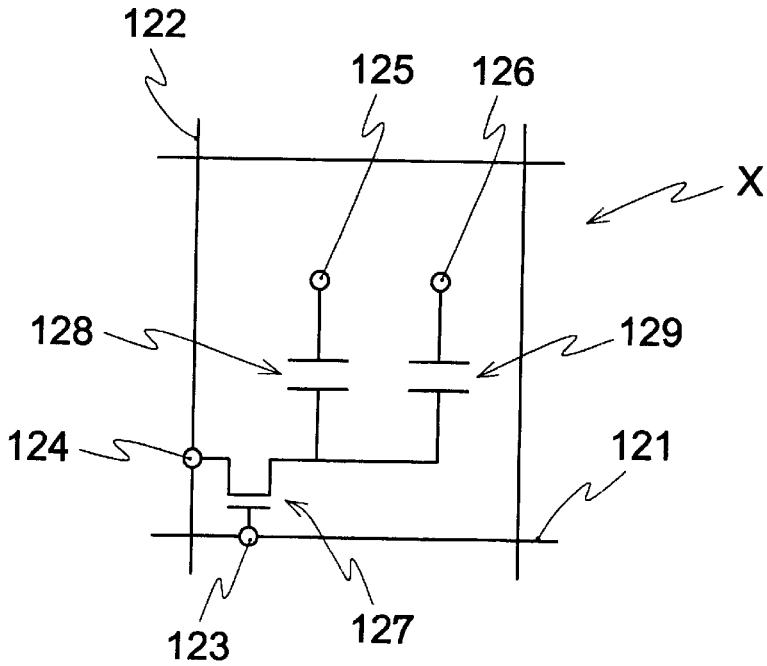
Figure 13:
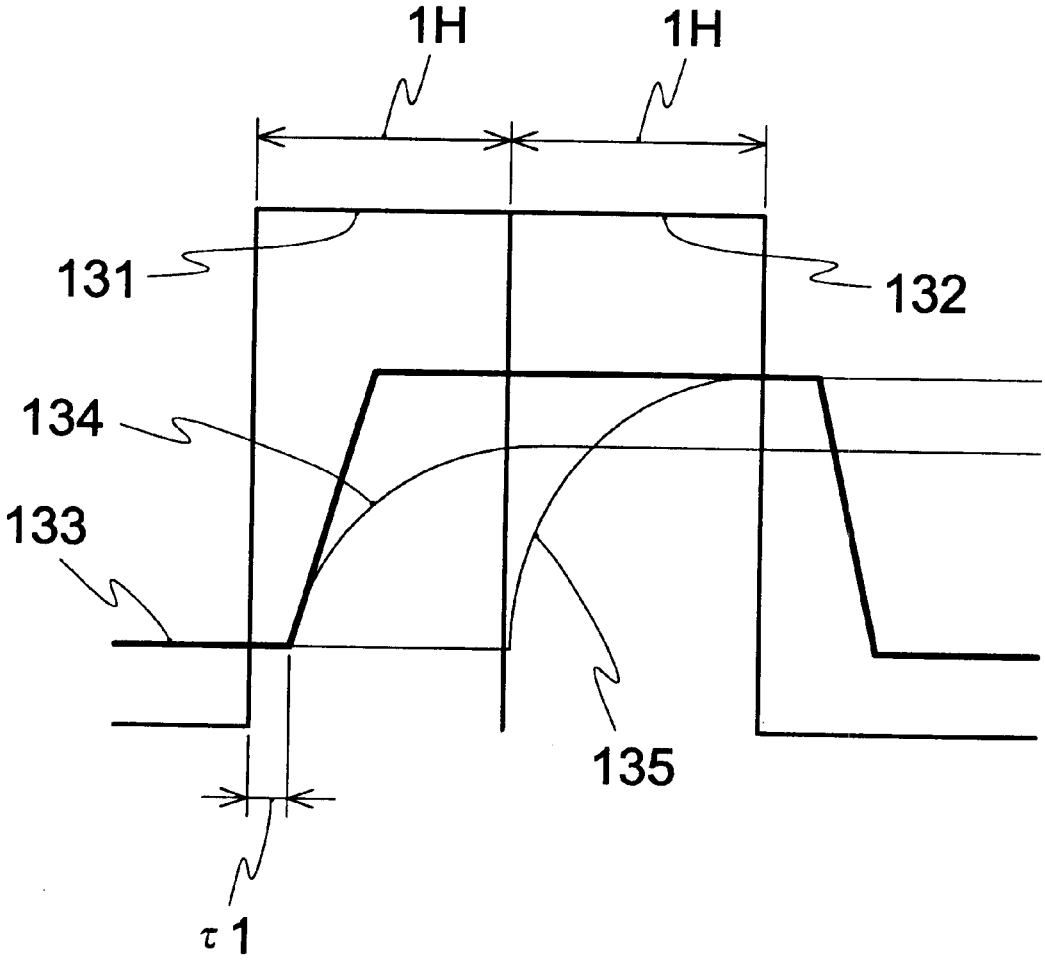
FIG. 13 is a graph of operating wave form for showing a function of the (2×1) dot inversion driving system of the conventional active matrix display.
Figure 14:
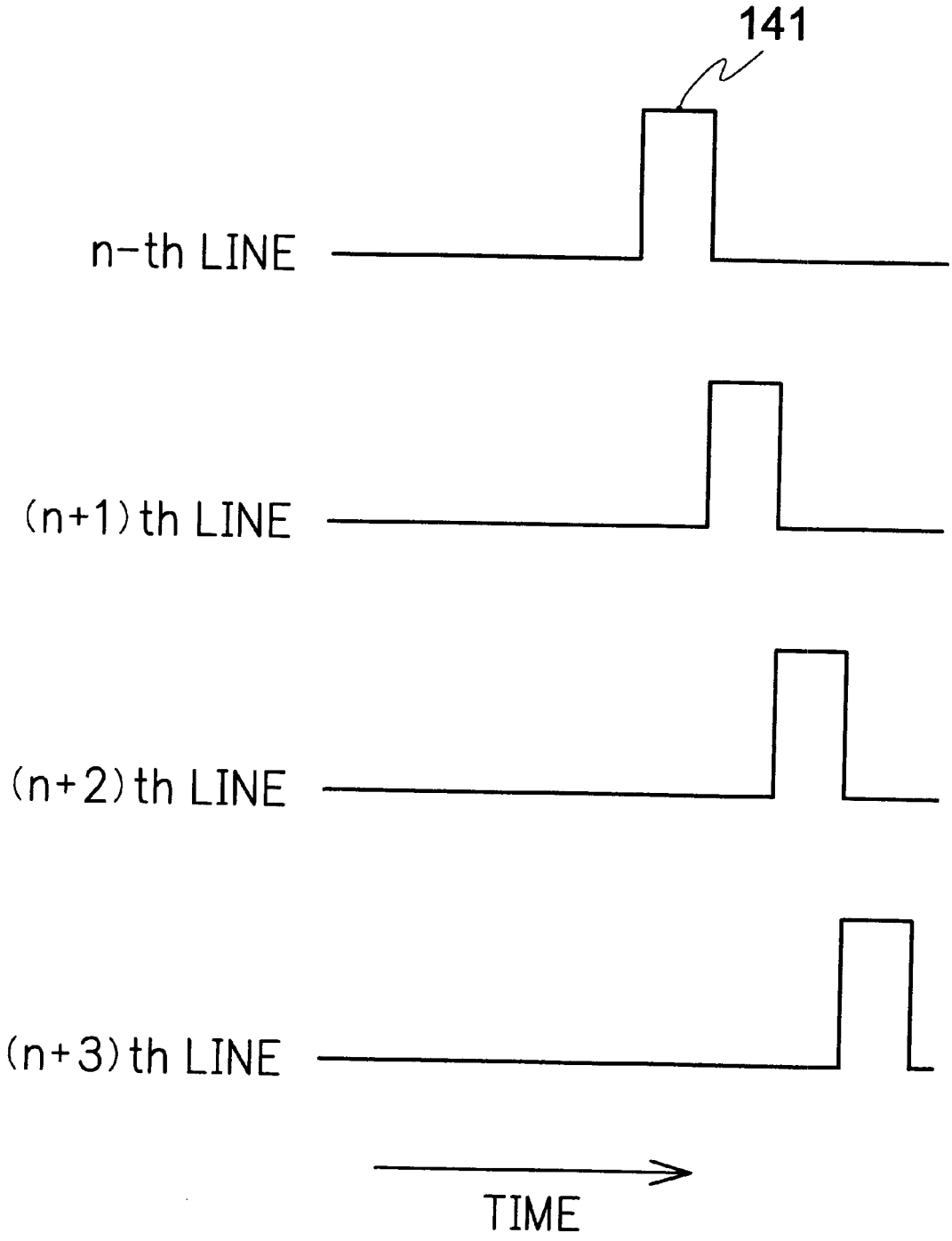
FIG. 14 is a graph of gate wave form for showing a function of the (2×1) dot inversion driving system of the conventional active matrix display.
Figure 15:
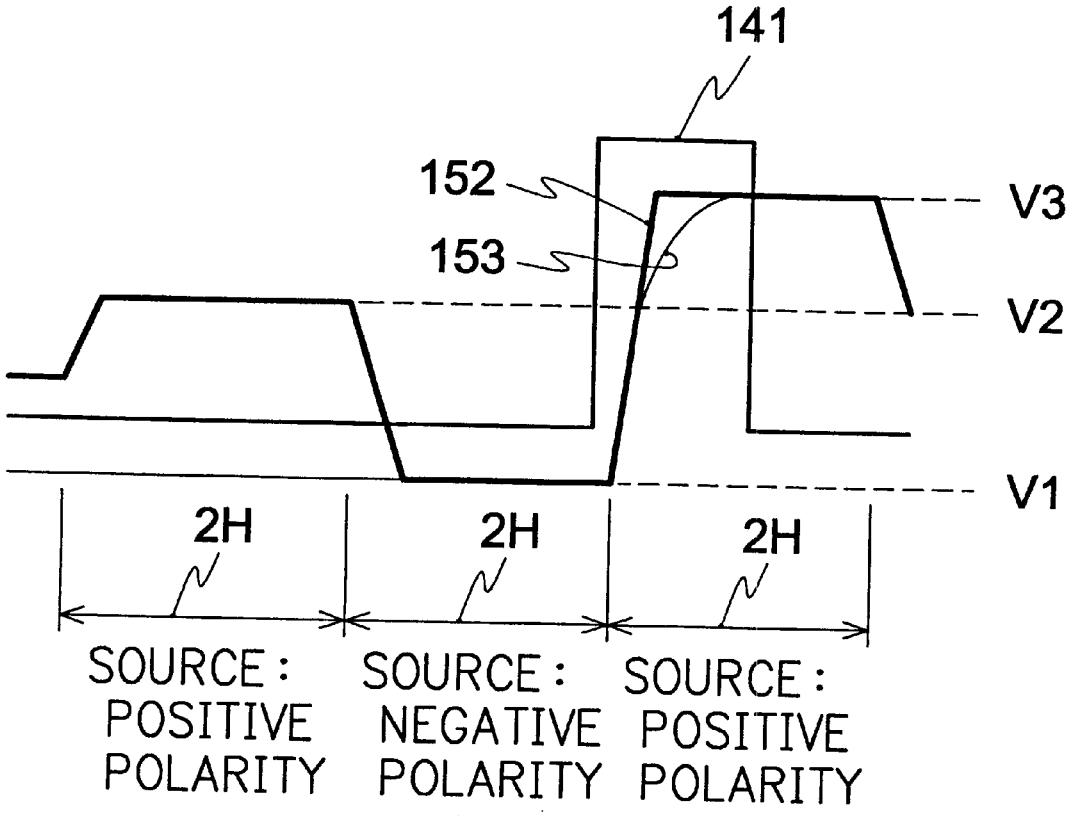
FIG. 15 is a graph of operating wave form for showing a function of the (2×1) dot inversion driving system of the conventional active matrix display.

In the (2×1) dot inversion driving system, FIGS. 10(*a*)–10(*d*) show gate waveforms 101, 102, 103 and 104 and FIG. 11 shows waveforms of gate potentials 101, 102, 103 and 104, a source potential 115, pixel potentials 116 and 117 of arbitrary pixels on n-th line and (n+1)th line. FIG. 10(*a*) corresponds to FIG. 11(*a*) and FIG. 10(*b*) corresponds to FIG. 11(*b*), respectively. The first selection pulse 101 having one horizontal scanning period is inputted to the gate wire 1; (4×m) horizontal scanning periods (m=1, 2, 3, . . . ) before this, the third selection pulse 103 having two horizontal scanning periods is inputted to the gate wire 1, while the second selection pulse 102 having one horizontal scanning period is inputted to the gate wire 2; and ((4×m)+1) horizontal scanning periods (m=1, 2, 3, . . . ) before this, the fourth selection pulse 104 having two to horizontal scanning periods is inputted to the gate wire 2. FIGS. 10 and 11 show cases in which m=1.

The effects of the present invention are the same as Embodiment 6; however, since the pulse width of the selection pulses 103 and 104 become twice the pulse width of the selection pulse 3 in Embodiment 6, the pixel charging characteristics of the selection pulses 103 and 104 are improved as compared with Embodiment 6.

Moreover, in the above-mentioned embodiments, explanations have been given of the application of the present invention to the (2×1) dot inversion driving system; however, the present invention may of course be applied to other inversion driving systems such as (3×1) dot and (4×1) dot systems.

In the liquid crystal display of the present invention which is an active matrix liquid crystal display of the (2×1) dot inversion driving system, charging characteristics of the pixel are made uniform both at the time of selecting the n-th line gate wire 1 at which the polarity of the source potential is inverted and at the time of selecting the (n+1)th line gate wire 2 at which no inversion is made in the source potential. Consequently, it becomes possible to reduce unevenness in luminance occurring in each line in raster display.

What is claimed is:

1. An active matrix liquid crystal display of (2×1) dot inversion driving system, comprising:

a plurality of pixels arranged in a matrix format; and intersecting gate and source lines configured to drive the plurality of pixels, wherein when said active matrix display is driven, voltage is applied to the plurality of pixels in such a manner that polarity is changed every source line in the horizontal direction and every two gate lines in the vertical direction, and wherein charging characteristics of the pixel are made uniform both at the time of selecting the n-th line gate wire 1 at which the polarity of the source potential is inverted and at the time of selecting the (n+1)th line gate wire 2 at which no inversion is made in the source potential, whereby unevenness in luminance occurring in each line in raster display can be reduced.

2. The active matrix liquid crystal display of claim 1, wherein as compared with a first selection pulse at the time of selecting the n-th line gate wire 1, a second selection pulse at the time of selecting the (n+1)th line gate wire 2 is set to have a shorter width to allow the charging characteristic of the pixels to be uniform both at the time of selecting the n-th line gate wire 1 and at the time of selecting the (n+1)th line gate wire 2.

3. The active matrix liquid crystal display of claim 2, wherein the first selection pulse is inputted to the gate line 1 before $\tau 1$ seconds from the time when the polarity of the source potential is changed, a pulse length of the first selection pulse is set to accord with a horizontal scanning period, the second selection pulse rises after $\tau 2$ seconds from the time when the first selection pulse falls, and a pulse length of the second selection pulse is shorter than the horizontal scanning period by $\tau 2$ seconds to decrease the pulse length of the second selection pulse inputted to the gate line 2 as compared with the first selection period in the (2×1) dot inversion driving.

4. The active matrix liquid crystal display of claim 1, wherein both the pulse length of the first selection pulse and the pulse length of the second selection pulse are made smaller to allow the charging characteristic of the pixels to be uniform both at the time of selecting the gate line 1 and selecting the gate line 2 in the (2×1) dot inversion driving.

5. The active matrix liquid crystal display of claim 4, wherein the first selection pulse is applied to the gate line 1 after the source potential established a predetermined potential; the pulse length of said first selection pulse is set in such a manner that $\tau 3$ is subtracted from the horizontal scanning period; $\tau 3$ is set in such a manner as to be greater than a value obtained by adding the time lag of the first selection pulse to the time lag of the source potential; the second selection pulse is applied to the gate line 2 at the time when the first selection pulse falls; and the pulse length of the first selection pulse is the same as that of the second selection pulse to shorten the pulse length of the first and second selection pulse in the (2×1) dot inversion driving.

6. The active matrix liquid crystal display of claim 1, the pulse length of the first selection pulse and the pulse length of the second selection pulse are arbitrarily set.

7. The active matrix liquid crystal display of claim 1, wherein control pulses having 0 and Vcc are generated on a circuit substrate of the active matrix liquid crystal display when the selection pulses in a form of a binary values composed of Vg1 and Vg2 are formed; a time and a pulse length of the selection pulse are arbitrarily set in the (2×1) dot inversion driving by inputting the selection pulse Vg2 when electric potential of the control pulse is Vcc, and inputting the selection pulse Vg1 when electric potential of the control pulse is 0 as a means for setting the time and pulse length.

8. The active matrix liquid crystal display of claim 1, wherein the driving performance of the switching element provided on the gate line 1 is superior to that of the switching element provided on the gate line 2 to allow the charging property to be even both in the time of selecting the gate line 1 and in the time of selecting the gate line 2.

9. The active matrix liquid crystal display of claim 8, wherein the switching element is a thin film transistor; wherein a coefficient (W/L) of the thin film transistor provided on the gate line 1 is greater than that of the thin film transistor provided on the gate line 2; and wherein said W is a channel width and said L is a channel length.

10. The active matrix liquid crystal display of claim 1, wherein the second selection pulse is inputted to the gate line 2, followed by allowing the state of the switching element to be "ON", said switching element being provided on the pixels formed on the gate line 2, whereby the electric charge to be supplied to the pixels is suppressed for a predetermined period.

11. The active matrix liquid crystal display of claim 1, wherein the second selection pulse is inputted to the gate line 2, followed by allowing the state of the switching element to be "ON", said switching element being provided on the pixels formed on the gate line 2, wherein the electric charge to be supplied to the pixels is suppressed for a predetermined period by allowing an output resistance of the source IC to be high solely for the predetermined period.

12. The active matrix liquid crystal display of claim 1, wherein a third and fourth selection pulses are respectively inputted to the gate line 1 and gate line 2 before the first and second selection pulses are respectively inputted to the gate line 1 and the gate line 2.

13. The active matrix liquid crystal display of claim 12, wherein the third and fourth selection pulses are respectively inputted to the gate line 1 and gate line 2 by inputting the third and fourth selection pulses to the gate line 1 and the gate line 2 before (4×m) horizontal scanning period for inputting the first and second selection pulses to the gate line 1 and the gate line 2; and wherein said m is an integer which is at least 1.

14. The active matrix liquid crystal display of claim 12, wherein the first selection pulses at a period of 1 horizontal scanning are inputted to the gate line 1; the third selection pulses are inputted to the gate line 1 at the time before a period of (4×m) horizontal scanning from the period of 1 horizontal scanning, each pulse length of said third selection pulse corresponding to a period of 2 horizontal scanning; the second selection pulses at another period of 1 horizontal scanning are inputted to the gate line 2; the fourth selection pulses are inputted to the gate line 2 at the time before a period of ((4×m)+1) horizontal scanning from said another period of 1 horizontal scanning, each pulse length of said fourth selection pulses corresponding to a period of 2 horizontal scanning.

* * * * *